US009404715B2

(12) United States Patent
Rensink

(10) Patent No.: US 9,404,715 B2
(45) Date of Patent: Aug. 2, 2016

(54) BALLISTIC COLLAR

(75) Inventor: Pim Rensink, Utrecht (NL)

(73) Assignee: NEDERLANDSE ORGANISATIE VOOR TOEGEPAST-NATUURWETENSCHAPPELIJK ONDERZOEK TNO, Delft (NL)

( * ) Notice: Subject to any disclaimer, the term of this patent is extended or adjusted under 35 U.S.C. 154(b) by 132 days.

(21) Appl. No.: 13/125,584

(22) PCT Filed: Oct. 23, 2009

(86) PCT No.: PCT/NL2009/050645
§ 371 (c)(1),
(2), (4) Date: Jul. 8, 2011

(87) PCT Pub. No.: WO2010/047598
PCT Pub. Date: Apr. 29, 2010

(65) Prior Publication Data

US 2011/0259186 A1 Oct. 27, 2011

(30) Foreign Application Priority Data

Oct. 23, 2008 (EP) ..... 08167457

(51) Int. Cl.
*F41H 1/02* (2006.01)

(52) U.S. Cl.
CPC ..... *F41H 1/02* (2013.01); *Y10T 29/49826* (2015.01)

(58) Field of Classification Search
CPC ..... F41H 1/02
USPC ..... 2/129, 98, 69, 2.5, 455, 468, 202, 205
See application file for complete search history.

(56) References Cited

U.S. PATENT DOCUMENTS

| | | | | |
|---|---|---|---|---|
| 932,880 | A * | 8/1909 | Meikle | 128/201.29 |
| 2,982,969 | A * | 5/1961 | Parker | 2/82 |
| 3,030,626 | A | 4/1962 | Shepard | |
| 3,432,860 | A | 3/1969 | Durney | |
| 3,514,785 | A | 6/1970 | Smith | |
| 4,324,003 | A | 4/1982 | Johnston | |
| 4,426,740 | A * | 1/1984 | Reverberi | 2/84 |
| 5,901,375 | A * | 5/1999 | Davis | 2/84 |
| 6,098,196 | A * | 8/2000 | Logan | 2/2.5 |
| 6,916,533 | B2 * | 7/2005 | Simmelink et al. | 428/364 |
| 2008/0139071 | A1 * | 6/2008 | Bhatnagar et al. | 442/414 |

FOREIGN PATENT DOCUMENTS

| | | | |
|---|---|---|---|
| CA | 1 242 051 | A | 9/1988 |
| EP | 1 533 587 | A1 | 5/2005 |
| FR | 2 730 301 | A1 | 8/1996 |
| GB | 2065449 | * | 7/1981 |

* cited by examiner

*Primary Examiner* — Anna Kinsaul

(57) ABSTRACT

Ballistic collar may include a bellows shaped member, which is arranged to surround a human's neck, including bellows plies being mainly perpendicular to the axis of the collar or of the human's neck. Free standing, the structure stands up around the neck to provide ballistic protection. The structure may be formed by folding a sheet of ballistic rated body armor fabric including strong synthetic fibers, e.g. from aromatic polyamide fibers, or ultra high molecular weight polyolefin, e.g. polyethylene polypropylene, fibers. For manufacturing the ballistic collar, a plurality of sheets may be piled-up and the whole may be submitted to transformation in a mold at a temperature and pressure at which the sheets remain mainly loose from each other. Preferably parts of the collars or bellows shaped members are made, which are assembled afterwards e.g. by stitching, welding etc.

19 Claims, 2 Drawing Sheets

BALLISTIC COLLAR

CROSS-REFERENCE TO RELATED APPLICATIONS

This application is filed under 35 U.S.C. 371 as a U.S. national phase application of PCT/NL2009/050645, having an international filing date of 23 Oct. 2009, which claims the benefit of European Patent Application No. 08167457.4, having a filing date of 23 Oct. 2008, both of which are hereby incorporated by reference.

FIELD OF THE INVENTION

The invention relates to a ballistic collar, i.e. a collar which is intended for protection against bullets, shrapnel etc and a method of manufacturing such a collar. An embodiment of the invention relates to a ballistic neck collar, for protection of the neck.

BACKGROUND

EP 1533587 describes body protection by means of rigid armor plates. The document notes that such plates can hinder motion, for example when the bearer has to assume a crouching stances. To allow for an easily deformable body protection a plurality of overlapping plates is used, with variable overlap between the plates. The variable overlap is made possible by connections with pegs between successive pairs of plates, the peg being hingingly connected to one plate and sliding in a slot in the other plate. The document mentions that the plate assembly can protect an operative's neck, chest and abdomen.

In times of war many soldiers are killed or wounded by injuries of their face or neck. Besides the face, the neck is a weak point in the ballistic protection of soldiers. Due to the high extent of mobility of the head and the properties of the present ballistic materials and manufacturing methods it is hard to make a neck protection which does not hinder the head movements and nevertheless provides a good ballistic protection level including a sufficient protection surface.

Present neck protection collars are a compromise of both: a certain extent degree of protection and a certain degree of flexibility, however, both being unsatisfactory. The interaction between de ballistic neck protection and the ballistic helmet causing mobility when the soldier is in prone position, while in standing position an ballistic gap may be formed between the helmet and the collar.

U.S. Pat. No. 4,324,003 describes a throat guard for protecting the neck for sportsmen. The throat guard comprises a series of overlapping rigid U-shaped bands. The uppermost band is suspended from the head of the wearer and the lowermost band is attached at chest level. The overlapping U-shaped bands provide for a combination of protection and flexibility, reducing or increasing the overlap with movement of the head. However, the need to suspend the bands from the head makes wearing cumbersome and reduces the freedom of motion of the head.

SUMMARY

It may be desirable to provide a ballistic collar that combines good ballistic protection with freedom of movement. A ballistic neck protection with freedom of movement of a soldier's head may be provided for example.

A ballistic collar is provided that comprises a body armor fabric folded into a structure with successive strips that run over into each other by folds of the fabric, the folds running substantially perpendicularly to an axial direction of the collar, whereby the collar may be expanded or compressed by increasing or decreasing fold angles between the strips at the folds. Thus a shape as in the compressible and expandable part of an accordion is realized, or in the bellows that used to be used in photographic cameras. This provides for a structure that stands up freely and can be compressed and expanded. In an embodiment the fabric is included in a matrix, such as a resin, preferably a resilient resin with sufficient stiffness sufficient to cause the structure to stand up freely in a compressible position.

It is preferred that the ballistic collar comprises a structure which is arranged to surround a human's neck. It is preferred that the plies of the structure are mainly perpendicular to the axis of the collar or of the human's neck. Besides, it is preferred that the structure is formed by a plurality of piled sheets.

As will be elucidated below, the shape of the proposed collar enables shortening and lengthening of the collar when the soldier's head moves upward-downward and/or left-right. Due to the (pre-)tension in the material the collar will always push itself upward, causing an optimal protection area at all sides, while the head is not hindered in its upward-downward or left-right movements.

The plurality of sheets preferably comprise sheets made of a ballistic rated body armor fabric comprising strong synthetic fibers, like aromatic polyamide fibers e.g. like Kevlar™ or Twaron™ However, the strong synthetic fibers may comprise, alternatively, ultra high molecular weight polyolefin (UHMWPO) fibers (see e.g. U.S. Pat. No. 6,916,533), e.g. ultra high molecular weight polyethylene (UHMWPE) fibers like e.g. Dyneema™ or Spectra™ or ultra high molecular weight polypropylene (UHMWPP) fibers e.g. Pure™.

A method for manufacturing a ballistic collar or at least the bellows shaped member preferably comprises the steps of

- providing a sheet to be used for the relevant ballistic collar;
- providing a mold arranged for sheet transformation, defining the shape of the ballistic collar;
- performing transformation of sheet at a temperature and pressure at which the sheets are deformable.

Thermoforming may be used for example or deep drawing. It may be preferred to thermoform parts of the collars first and to assemble the parts of the collars together e.g. by stitching, welding etc.

BRIEF DESCRIPTION OF THE DRAWING

These and other objects and advantageous aspects will become apparent from a description of exemplary embodiments, using the following figures.

DETAILED DESCRIPTION OF EXEMPLARY EMBODIMENTS

Figure 1:
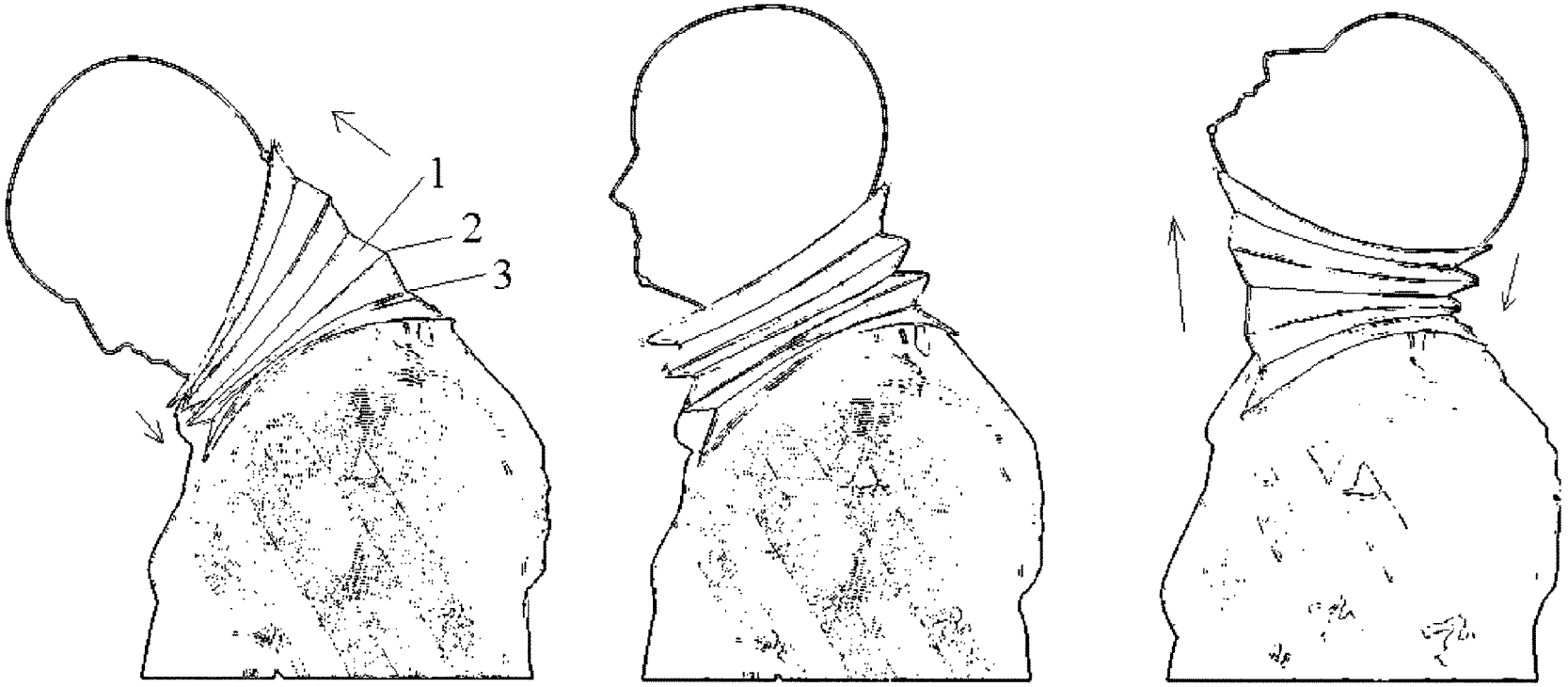
FIG. 1 shows an exemplary embodiment of a ballistic collar

FIG. 1 shows a ballistic collar which comprises a bellows shaped member 1 which is arranged to surround a human's neck. As used herein the term bellows shape refers to the type of shape that is shown in FIG. 1, as can be found in the bellows of accordion (in Dutch also called trek-harmonica) or old-fashioned photographic cameras. By way of example in FIG. 1, a soldier is shown wearing the collar. The collar, as shown, is an enclosed ring shape and has body armor fabric ending, at an upper end, with one of the successive strips that is configured to reach a chin of the human's head when the collar is in an expanded configuration.

Such a bellows shape is a folded structure with folds that connects plies, i.e. strips that are part of the folded structure. In a bellows shape the structure forms an expandable and compressible cylinder wall (not necessarily circular) formed by strips and folds extending perpendicularly to the axis of the cylinder. The structure has successive strips that run over into each other by folds of the fabric, the folds running substantially perpendicularly to an axial direction of the collar, whereby the collar may be expanded or compressed by increasing or decreasing angles between the strips at the folds. The fabric is preferably included in a matrix, such as a resilient resin, with sufficient stiffness sufficient to cause the structure to stand up freely in a compressible position.

In the embodiment shown in FIG. 1 the bellows folds 2 and 3 of the bellows shaped member run mainly perpendicular to the axis of the collar or—when in use—of the human's neck.

Expansion occurs when the fold angles open up (when the angle between the strips increases). Compression occurs when the folds angles narrow (when the angle between the strips decreases). When no dynamic force is exerted (just gravity) the bellows assumes an unloaded position with a non-zero fold angle between the strips.

The collar may be formed from one or more piled sheets of a ballistic rated body armor fabric in a matrix of resilient resin. The one or more sheets are folded into the bellows shaped structure. The resilient resin may be rubber or synthetic rubber for example. The matrix serves to preserve the folds in the fabric in the bellows shaped structure and to provide for expandability and compressibility of the bellows. In addition, when a plurality of sheets is used, the matrix binds the piled sheets.

The bellows shaped member may be formed from one or more sheets made of a ballistic rated body armor fabric comprising strong synthetic fibers, e.g. comprising aromatic polyamide fibers, ultra high molecular weight polyolefin, e.g. polyethylene or polypropylene fibers. The sheet of fibers may be embedded in resin, preferably resilient resin, such as rubber or synthetic rubber to form the matrix. The sheet may be folded to pre-form the bellows shape. Preferably, the combination of the folded sheet and resin is formed into the folded structure when the resin is in a plastically deformable state (e.g. heated or before curing of the resin), so that it undergoes a transition to a substantially only elastically deformable state afterwards (a substantially not plastically deformable state). Thus an unloaded state of the bellows structure can be realized wherein the bellows stands up in a position from which it can be compressed or expanded as a result of movement. The height of the structure preferably equals the height of the structure to be protected, such as the average height of the human neck. A mold may be used to perform the folding. The resin may be cured after folding, or cooled from a thermoplastic state.

In an embodiment ends of the folded structure that extend parallel to the axis of the cylinder may be assembled e.g. by stitching, welding etc. after the folded structure has been formed. A one piece structure may be used, which loops around full circle to these ends. Alternatively a multi-piece structure may be used, with a plurality of assembly lines (e.g. stitching lines or weld lines) parallel to the axis of the cylinder at a plurality of positions in its circumference in a plane perpendicular to the axis.

Figure 2:
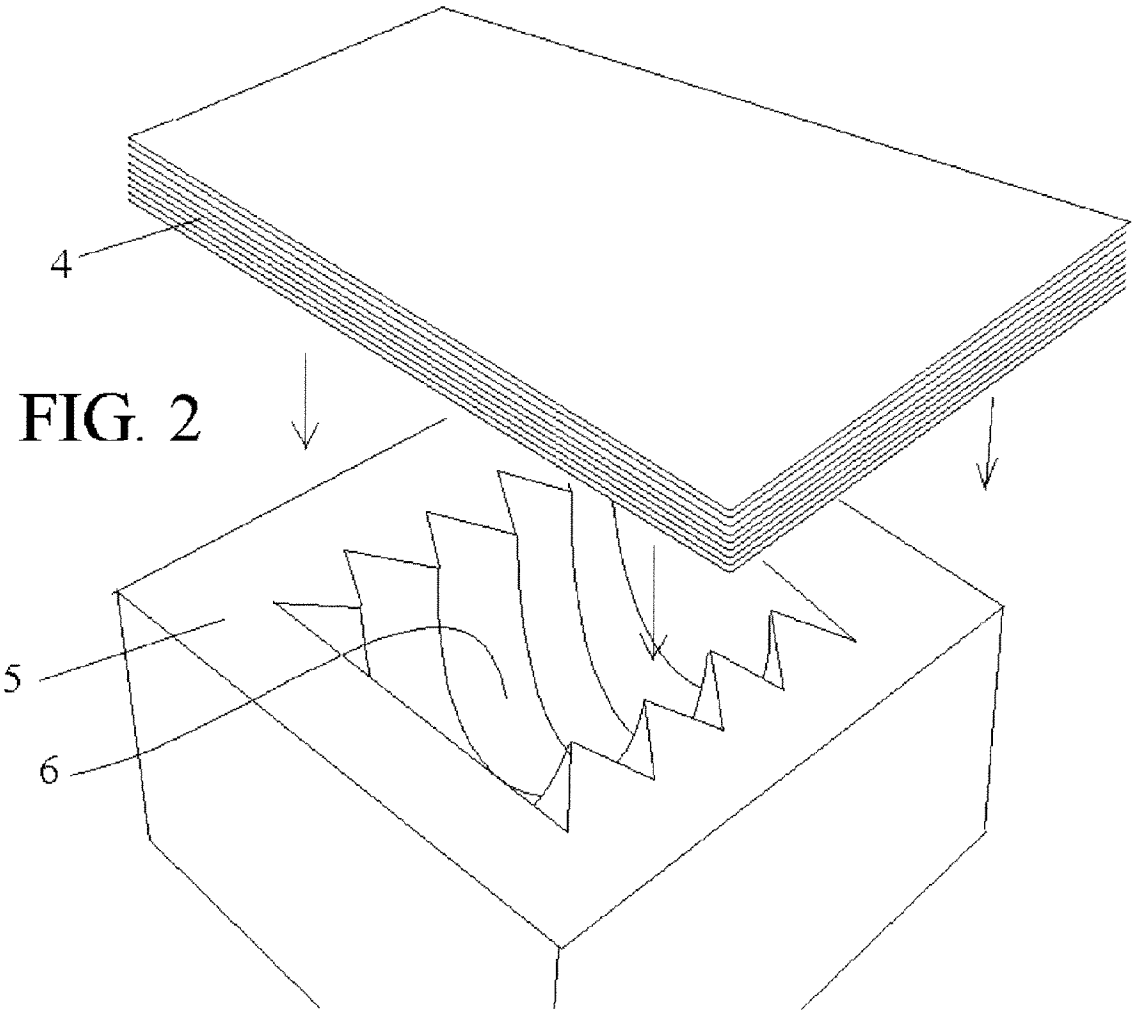
FIG. 2 gives an illustration of the manufacturing process of the ballistic collar

In an embodiment the bellows shaped member may be formed from a pile of a plurality of sheets 4, as shown in FIG. 2. The sheets are made of a ballistic rated body armor fabric comprising strong synthetic fibers, e.g. comprising aromatic polyamide fibers, ultra high molecular weight polyolefin, e.g. polyethylene or polypropylene fibers.

A method of manufacturing the ballistic collar or at least the bellows shaped member is schematically illustrated in FIG. 2, showing a piled of a plurality of thermoplastically deformable sheets 4 which are used as semimanufacture for manufacturing the ballistic collar or bellows shaped member. A mold 5 is provided, arranged for sheet transformation (incl. vacuum forming, blow molding etc.), which mold 5 has the shape of the (exterior of the) ballistic collar or bellows shaped member respectively or of a part of it. The mold can be a "positive mold" as illustrated in FIG. 2 or a "negative mold" (not shown). The sheets 4 are heated (by not shown heating means) and the transformation of the piled plurality of sheets is performed at a temperature and pressure at which the sheets remain mainly loose from each other, viz. below the melting temperature of the sheet material(s) but at a temperature and pressure level at which the sheets are weakened enough to be deformed smoothly in the (evacuated) mold cavity 6.

If the sheets, despite the precautions, would still stick together during deformation in the mold, the stacked sheets could be alternated with non-sticking sheets, e.g. made from PTFE ("Teflon"). An alternative would be to mold all separate sheets separately, instead of as stack-wise, and to assemble them together afterward.

In FIG. 2 a half bellows member can be made. Two of such half members can afterwards be assembled to a complete bellows member by e.g. welding (i.e. melting) or stitching the half bellows members together at their borders, thus forming in a neck surrounding ballistic collar having excellent properties, viz. combining excellent ballistic and ergonomic properties.

A ballistic collar is provided that comprises a bellows shaped member (1) (also called accordion shaped member or harmonica shaped member, in view of the Dutch "trek-harmonica), which is arranged to surround a human's neck. In an embodiment the bellows plies (2, 3) of the bellows shaped member may be mainly perpendicular to the axis of the collar or of the human's neck. In an embodiment the bellows shaped member may be formed by a plurality of piled sheets (4). In a further embodiment the plurality of sheets comprising sheets made of a ballistic rated body armor fabric comprising strong synthetic fibers. In an embodiment the strong synthetic fibers may comprise aromatic polyamide fibers. In an embodiment the strong synthetic fibers may comprise ultra high molecular weight polyolefin (UHMWPO) fibers. In an embodiment the strong synthetic fibers comprising ultra high molecular weight polyethylene (UHMWPE) fibers. In an embodiment the strong synthetic fibers may comprise ultra high molecular weight polypropylene (UHMWPP) fibers.

In an embodiment a method of manufacturing a ballistic collar or at least the bellows shaped member according comprises: providing and piling up a plurality of sheets to be used for the relevant ballistic collar or bellows shaped member; providing a mold (5, 6) arranged for sheet transformation, having the shape of the ballistic collar or bellows shaped member respectively or of a part of it; performing transformation of the piled plurality of sheets at a temperature and pressure at which the sheets remain mainly loose from each other. In an embodiment the method comprises transforming parts of the collars or bellows shaped members; assembling the parts of the collars or bellows shaped members together e.g. by stitching, welding etc.

What is claimed is:

1. A ballistic collar for protection against bullets and shrapnel, comprising:

a structure of body armor fabric with successive strips that run over into each other by folds of the fabric, each of the folds running substantially perpendicularly to a vertical axial direction of the collar;

a matrix of preformed resilient resin, the body armor fabric located in the matrix, the matrix of preformed resilient resin having sufficient stiffness to cause the structure to stand up freely as a resiliently vertically compressible and expandable collar to completely surround a human's neck, whereby the collar will be expanded or compressed resiliently at the front and the back of the neck during head movements, increasing or decreasing fold angles between the strips at the folds; and wherein the body armor fabric ends at an upper edge with one of the successive strips, wherein the upper edge is configured to reach a chin of a human's head when the collar is expanded.

2. A ballistic collar according to claim 1, wherein the structure comprises a plurality of piled sheets of body armor fabric, commonly folded into the structure.

3. A ballistic collar according to claim 1, wherein the body armor fabric is included in the matrix, with sufficient stiffness to cause the structure to stand up freely in a compressible position with non-zero fold angles, keeping the fabric folded but not fully compressed according to the structure when the structure stands up freely.

4. A ballistic collar according to claim 1, wherein the body armor fabric comprises aromatic polyamide fibers.

5. A ballistic collar according to claim 4, wherein the body armor fabric comprises ultra high molecular weight polyolefin (UHMWPO) fibers.

6. A ballistic collar according to claim 4, wherein the body armor fabric comprises ultra high molecular weight polyethylene (UHMWPE) fibers.

7. A ballistic collar according to claim 4, wherein the body armor fabric comprises ultra high molecular weight polypropylene (UHMWPP) fibers.

8. A ballistic collar according to claim 1, wherein the structure is a bellows shaped structure.

9. A ballistic collar according to claim 1, wherein the structure further comprises plies of a bellows shape substantially perpendicular to the vertical axis of the collar.

10. A method of manufacturing a ballistic collar, the method comprising:

providing a sheet of body armor fabric;

providing a mold arranged for sheet transformation, the mold defining a structure of positions of strips and folds;

performing transformation of the sheet in the mold at a temperature and pressure at which the sheet is plastically deformable;

assembling the ballistic collar, the ballistic collar comprising the transformed sheet having successive strips that run over into each other by folds in an enclosed ring shape;

wherein the assembled ballistic collar ends at an upper edge with one of the successive strips; and wherein the assembled ballistic collar is resiliently vertically compressible and expandable and the folds run substantially perpendicularly to the vertical axial direction of the collar and the upper edge is configured to reach a chin of the human's head when the collar is expanded.

11. Method according to claim 10, wherein the assembling step includes one of stitching and welding.

12. A ballistic collar according to claim 2, wherein the plurality of piled sheets is included in the matrix, with sufficient stiffness to cause the structure to stand up freely in a compressible position with non-zero fold angles, keeping the fabric folded, but not fully compressed according to the structure when the structure stands up freely.

13. A ballistic collar for protection against bullets and shrapnel, comprising:

a structure of folded body armor fabric with successive strips that run over into each other by folds of the fabric, the folds running substantially perpendicularly to a vertical axial direction of the collar, whereby the collar may be expanded or compressed by increasing or decreasing fold angles between the strips at the folds, wherein all strips of the successive strips of the body armor fabric are arranged to completely surround a neck of a human's head, the body armor fabric ending, at an upper end, with one of the successive strips that is configured to reach a chin of the human's head when the collar is in an expanded configuration, and wherein the body armor fabric is embedded in a resilient resin to form a matrix.

14. A ballistic collar according to claim 1, wherein the preformed resilient resin is a cured or thermoplastic resin.

15. A ballistic collar according to claim 1, wherein the preformed resilient resin is a rubber or a synthetic rubber.

16. A method according to claim 10, further comprising providing the sheet of body armor fabric in a pile of sheets and performing a transformation of the pile of sheets in the mold at the temperature and pressure at which the pile of sheets is plastically deformable.

17. A method of manufacturing a ballistic collar, the method comprising:

providing a sheet of body armor fabric;

providing a mold arranged for sheet transformation, the mold defining a structure of positions of strips and folds;

forming a combination of the sheet and a resin into a folded structure in the mold at a temperature and pressure at which the sheet and resin are in a plastically deformable state;

subsequently causing the resin in the combination to undergo a transition to a substantially only elastically deformable state, assembling the ballistic collar, the ballistic collar comprising the combination having successive strips that run over into each other by folds in an enclosed ring shape;

wherein the assembled ballistic collar ends at an upper edge with one of the successive strips; and wherein the assembled ballistic collar is resiliently vertically compressible and expandable and the folds run substantially perpendicularly to the vertical axial direction of the collar and the upper edge is configured to reach a chin of the human's head when the collar is expanded.

18. A method according to claim 17, comprising curing the resin after forming the folded structure.

19. A method according to claim 17, wherein the resin is cooled from a thermoplastic state after forming the folded structure.

* * * * *